United States Patent [19]

Heider

[11] 4,429,342

[45] Jan. 31, 1984

[54] IMPACT PRINTING DEVICE WITH AN IMPROVED PRINT HAMMER

[75] Inventor: Ulrich Heider, Munich, Fed. Rep. of Germany

[73] Assignee: Siemens Aktiengesellschaft, Berlin & Munich, Fed. Rep. of Germany

[21] Appl. No.: 368,455

[22] Filed: Apr. 14, 1982

[30] Foreign Application Priority Data

Apr. 24, 1981 [DE] Fed. Rep. of Germany ..... 3116402
Dec. 8, 1981 [DE] Fed. Rep. of Germany ..... 3148503

[51] Int. Cl.[3] ..... B41J 9/00; H01H 47/00

[52] U.S. Cl. ..... 361/152; 101/93.29; 101/93.34; 101/93.43; 101/93.48; 335/255

[58] Field of Search ..... 361/152, 153, 154; 335/255, 258; 101/93.48, 93.29, 93.34, 93.43

[56] References Cited

U.S. PATENT DOCUMENTS

| | | | |
|---|---|---|---|
| 2,844,680 | 7/1958 | Christy et al. | 335/255 X |
| 3,860,894 | 1/1975 | Popovic et al. | 335/258 |
| 4,004,505 | 1/1977 | Magnenet | 101/93.48 |
| 4,329,921 | 5/1982 | Treider et al. | 101/93.02 |

FOREIGN PATENT DOCUMENTS

| | | | |
|---|---|---|---|
| 1454857 | 11/1976 | United Kingdom | 335/258 |
| 2004504 | 4/1979 | United Kingdom . | |

OTHER PUBLICATIONS

IBM Technical Disclosure Bulletin, vol. 15, No. 8, Jan. 1973, p. 2356; vol. 19, No. 6, Nov. 1976, p. 2036; vol. 21, No. 6, Nov. 1978, pp. 2283–2284.

*Primary Examiner*—Reinhard J. Eisenzopf
*Attorney, Agent, or Firm*—Hill, Van Santen, Steadman & Simpson

[57] ABSTRACT

An impact printing device having a plunger-type magnet system has an armature consisting of two joined portions which are a cylindrical principal portion and a guide portion which serves as the printing hammer. The principal portion of the armature consists of material of high magnetic permeability and carries a cylindrical peg thereon which mates with a corresponding receptacle in the printing hammer, which is comprised of non-magnetic material. The principal portion and the peg thereon terminate at sharp edges which cause the magnetic lines of force to converge at those edges thereby increasing the kinetic energy available for moving the armature during a printing stroke. A position sensor is connected to a drive circuit for the magnet system for controlling acceleration of the armature on its way to the striking point and deceleration of the armature during a return after a printing stroke in accordance with the speed of the returning armature.

15 Claims, 11 Drawing Figures

IMPACT PRINTING DEVICE WITH AN IMPROVED PRINT HAMMER

BACKGROUND OF THE INVENTION

1. Field of the Invention

The present invention relates to impact printing devices and in particular to an improved print hammer for such devices and means for actuating the print hammer.

2. Description of the Prior Art

Plunger-type armature magnet systems are generally known in printing technology and have been successfully utilized as drive devices for the print hammer in type printing devices or for the printing needles in mosaic printing systems. Such a plunger-type armature magnet system for a type printing device is described, for example, in IBM Technical Disclosure Bulletin, Vol. 15, No. 8, January, 1973 at page 2356, and a drive circuit for print hammer systems is disclosed in IBM Technical Disclosure Bulletin, Vol. 19, No. 8, January, 1977 at pages 3107–3108.

The maximally attainable printing speed of impact printers employing plunger-type armature magnet systems for driving the print hammers of the printer is essentially governed by two factors. The first factor is the striking speed of the print hammer and the second factor is the amount of time necessary to return the print hammer of the magnet system to its initial rest position without significant rebounding oscillations after a character is printed.

The speed of movement of the armature in a plunger-type armature magnet systems essentially is controlled by the strength of the magnetic field generated by the excitation coil of the magnet system. When a plunger-type magnet system is employed as a drive device for the print hammer of a carriage moving line by line along a recording medium, the size and current handling capacity of the excitation coil are limited by the geometrical dimensions of the carriage which limit the cooling technology which can be utilized as well as limiting the weight of the magnet system.

The return velocity of the armature after completion of a printing stroke in a plunger-type armature magnet system, and thus the minimum time which must elapse until the magnet system can again be activated, greatly depends upon the damping to which the print hammer is subject at the recording medium. The degree of damping acting on the print hammer depends, among other factors, on the number of pieces of paper, that is, the number of copies, which are present at the printing station. A larger number of copies absorbs more kinetic energy from the print hammer during printing of a character and therefore subjects the print hammer to a greater amount of damping than a small number of copies.

SUMMARY OF THE INVENTION

It is an object of the present invention to provide a plunger-type armature magnet system for driving the print hammer in an impact printing device or a mosaic printer such that, given minimum size dimensions and minimum excitation current, generates a propulsive thrust for driving the armature and the print hammer which is as high as possible.

It is a further object of the present invention to provide such a magnet system wherein the armature after printing of a character is returned as quickly as possible to its initial position with a minimum of oscillation.

The above objects are inventively achieved in a plunger-type armature magnet system for a printing device which has a stationary yoke comprised of a material of high magnetic permeability and which has a central recess for receiving an armature which serves as the print hammer. The armature in a rest position is biased against a stop by a bias means such as a spring. The armature has a piston-like principal portion comprised of a material of high magnetic permeability and which, upon excitation of an excitation coil wound around the armature, moves in an essentially straight-line path through the yoke recess thereby closing the air gap. The termination of the recess in the yoke toward which the armature moves upon actuation, and the front part of the principal portion of the armature, exhibit sharp edges thereby causing magnetic lines of force to converge at those edges, thus increasing the kinetic energy which is imparted to the armature, and thereby increasing the armature speed, without increasing the excitation current or the size of the excitation coil.

In a further embodiment of the invention the front part of the principal portion of the armature is formed with a plurality of concentric edges, which may be formed by one or more annular grooves in the leading portion of the armature, so that the magnetic lines of force converge at each of the edges thereby further increasing the kinetic energy available for moving the armature. In a further embodiment of the invention, the armature is comprised of a principal portion of high magnetic permeability comprised of, for example, soft iron, and the leading portion of the armature is comprised of non-magnetic material. The two portions are joined by a peg, also of high magnetic permeability material, carried on the principal portion which is received in a corresponding recess in the non-magnetic leading portion. In this embodiment the leading edge of the principal portion of the armature and the leading edge of the peg cause the magnetic lines of force to converge thereby increasing the available kinetic energy. The non-magnetic leading portion of the armature also serves as a guide element. Various configurations for the leading portion of the armature may be interchangeably mounted on the peg of the principal portion of the armature.

A drive circuit for the magnet system has a position sensing means which provides control signals for optimally accelerating on the way to the printing point and decelerating the armature during a return after a printing stroke in accordance with the rebound speed of the armature so that each armature in a printing device can be individually optimally accelerated and decelerated with a minimum of oscillation.

DESCRIPTION OF THE PREFERRED EMBODIMENTS

Figure 1:
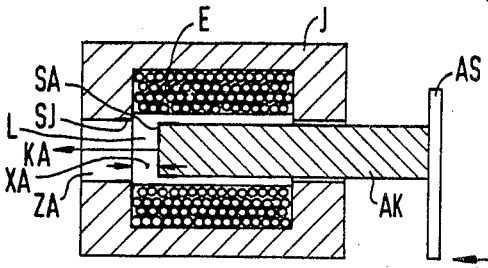
FIG 1 (PRIOR ART)
FIG. 1 is a sectional view of a conventional plunger-type armature magnet system.

A conventional plunger-type armature magnet system of the type which has heretofore been employed in impact and mosaic printing units as a drive means for the printing hammers of such units is shown in FIG. 1. The conventional magnet system comprises a stationary yoke J consisting of material of high magnetic permeability and having a central recess ZA. An armature AK, which serves as the print hammer, is supported against a stop AS in a rest position and extends through the central recess ZA of the yoke J. The armature AK of such a conventional magnet system is comprised entirely of material of high magnetic permeability. When current is supplied to an excitation coil E by means of a suitable drive circuit the armature AK moves essentially in a straight line through the central recess ZA of the yoke J, closing the air gap L. The curve of the axial force KA which propels the armature AK forward in order to print a character is shown as a function of the displacement XA in the diagram of FIG. 1*a* wherein the horizontal 0 coordinate corresponds to the rest position of the armature AK against the stop AS.

Figure 1A:
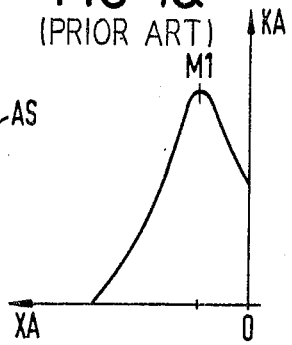
FIG 1a (PRIOR ART)
FIG. 1*a* is a force/displacement diagram for the conventional magnet system shown in FIG. 1.

As shown in FIG. 1*a*, as the armature AK moves toward the left in FIG. 1 upon activation of the excitation coil E the force KA first increases as the air gap L is closed, during which time the respective points SJ and SA of the yoke J and of the armature AK approach each other up to a maximum point M1. After reaching the maximum M1, the force decreases after the armature AK has passed through the central recess ZA. After the acceleration phase produced by the force KA, the armature AK continues in free flight until striking a spoke of a print wheel or coming into direct contact with the recording medium (not shown in FIG. 1). The total kinetic energy of the armature AK is equal to the area beneath the curve in FIG. 1*a*.

Figure 2:
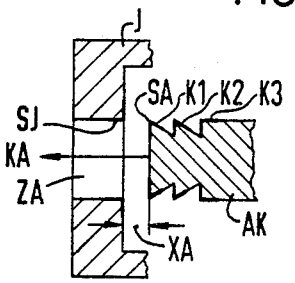
FIG. 2 is a sectional view of the front part of the principal portion of an armature constructed in accordance with the principles of the present invention having a plurality of annular edges.
Figure 3:
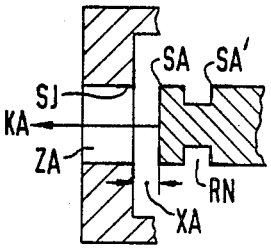
FIG. 3 is a sectional view of a portion of a further embodiment of an armature constructed in accordance with the principles of the present invention.
Figure 5:
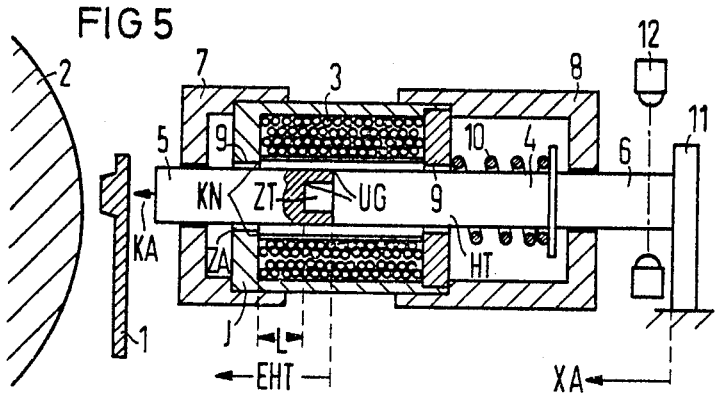
FIG. 5 is a sectional view of a plunger-type armature magnet system embodying the principles of the present invention having a position sensor.

By changing the configuration of the front part of the principal portion of the armature AK in accordance with the principles of the present invention, as shown in FIGS. 2, 3 and 5, the area beneath the associated force/displacement curves for such configurations, and thus the kinetic energy of the armature AK, is increased without additional amplification of the magnetic field by means of an increased excitation current in the excitation coil E.

Figure 2A:
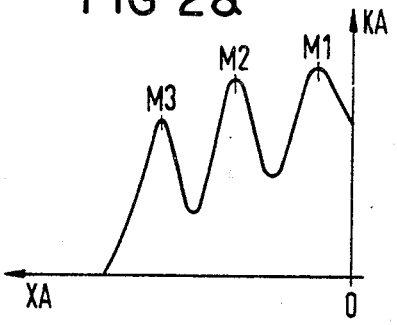
FIG. 2*a* is a force/displacement diagram for the structure shown in FIG. 2.

As shown in FIG. 2, the improved armature AK has a plurality of services K1, K2 and K3 which are formed by cutting a plurality of annular notches of varying depth in the leading or front portion of the armature AK so as to appear as a saw-tooth when seen in section as in FIG. 2. The outermost portions of the surfaces K1, K2 and K3 are a plurality of annular edges which have the effect in combination with the edge SJ of causing convergence of the magnetic lines of force at those edges during movement of the armature AK through the recess ZA resulting in the force/displacement diagram which is shown in FIG. 2*a*. The diagram of FIG. 2*a* exhibits three local maxima with local maximum M1 corresponding to the outermost edge SA of the surface K1, the local maximum M2 corresponding to the outermost edge of surface K2, and the local maximum M3 corresponding to the edge of surface K3. Because the area under the curve shown in FIG. 2*a* is larger than the area under the curve for conventional magnet systems shown in FIG. 1*a*, the kinetic energy of the armature AK is significantly increased without any increase in the excitation currents supplied to the excitation coil E. The speed with which the armature AK moves through the yoke J during a printing stroke is correspondingly increased.

Figure 3A:
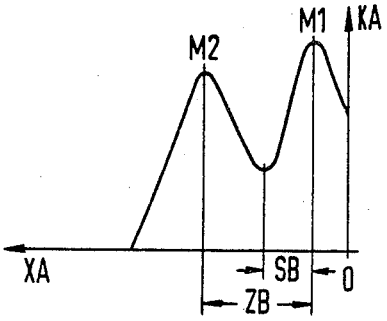
FIG. 3*a* is a force/displacement diagram for the structure shown in FIG. 3.

A further embodiment of an improved armature constructed in accordance with the principles of the present invention is shown in FIG. 3 wherein the front part of the principal portion of the armature AK has an annular channel RN therein thereby forming two edges SA and SA' which, in combination with the edge SJ, cause a convergence of the magnetic lines of force so that the armature AK in FIG. 3 exhibits the force/displacement curve shown in FIG. 3*a*. This curve has two local maxima, with local maximum M1 corresponding to the edge SA and local maximum M2 corresponding to the edge SA'. The curve in FIG. 3*a* has a range ZB between the two maxima M1 and M2. The range ZB has a sub-range Sb which is shown in an enlarged force/displacement diagram in FIG. 4. The sub-range SB can be used to decelerate the armature AK during its return to a rest position after a printing stroke, at which time the armature AK will be travelling in the negative XA direction, that is, toward the right side of FIG. 4 to a rest position at zero. During this return stroke, the excitation coil E can be momentarily energized to aid in decelerating the armature AK in order to minimize mechanical oscillation which occurs as a result of impact of the armature AK with the stop AS at the end of the return stroke. The deceleration force which is applied by the excitation coil E can be varied according to the amount of damping to which the armature AK is subjected by the act of printing a character. If, for example, a number of pages of paper are present in the printing station, the armature AK will be subjected to a higher degree of damping so that its speed during the rebound or return stroke will be lower, and a smaller deceleration force will be required. In such a case, the coil E may be energized after a determined delay period $\Delta t$, thereby moving a relatively short distance D1 for a period t and thereby causing the armature AK to exhibit a deceleration energy represented by the area F1 in FIG. 4. If a relatively few pages of paper are present at the printing station, less kinetic energy will be transferred from the armature AK during the act of printing and the rebound or return speed of the armature AK will be much higher, and accordingly a greater deceleration energy is needed. In this case, the armature AK moves during the predetermined delay period at a relatively longer distance D2 and the area of the excitation coil E for a period t will be different, thereby resulting in a deceleration energy for the armature AK represented by the area F2 in FIG. 4. Further details of the manner of decelerating the armature AK are described below.

Figure 4:
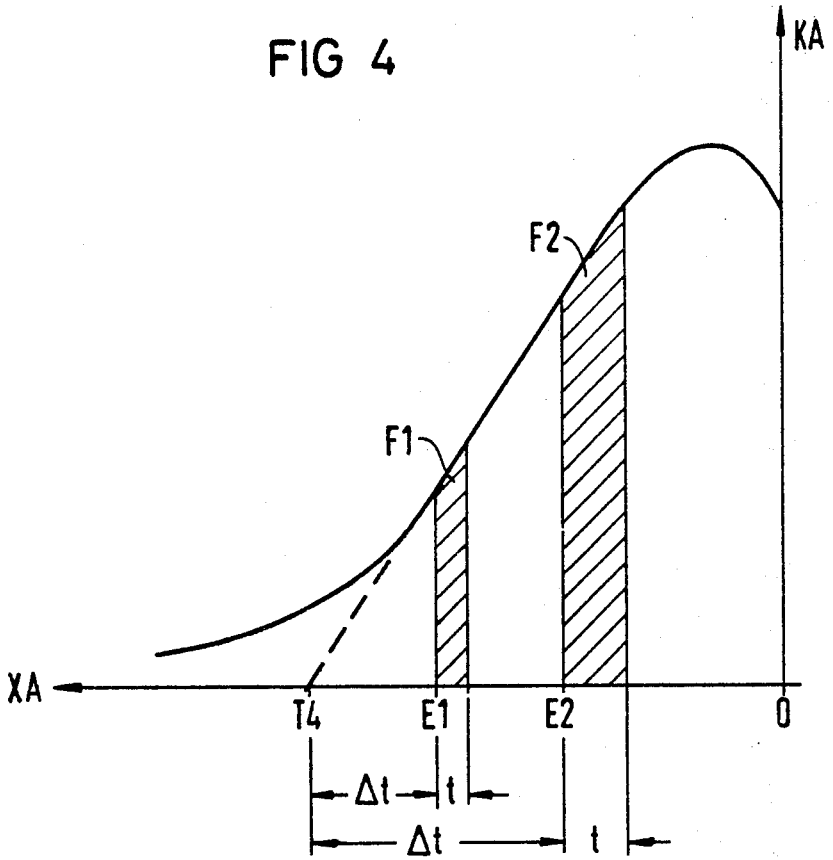
FIG. 4 is a force/displacement diagram for decelerating an armature constructed in accordance with the principles of the present invention.

A third embodiment of the improved armature is shown in FIG. 5 which includes a position sensing means 12, such as a photoelectric switch having a light beam which is interrupted by a guide portion 6 of the armature 4. The guide portion 6 during the return stroke of the armature interrupts the beam of the position sensor 12 at a time T4 as shown in FIG. 4 (and as also shown in FIG. 7 as described below). This causes a deceleration pulse t, delayed by the time delay Δt, to be generated by the circuit shown in FIG. 6. The geometry of the armature 4 is selected so that the deceleration pulse is generated when the returning armature is situated in the range SB of the force/displacement diagram at which position the edges of the armature 4 are best situated for effecting an axial deceleration thrust. This means that, for the duration of the delay Δt, the position at which the excitation coil E is energized by the deceleration pulse changes on the force/displacement curve as a function of the velocity of the returning armature from point E1 (slowly returning armature) to point E2 (rapidly returning armature) shown in FIG. 4. Even if the pulse duration t remains constant, the deceleration energy changes from F1 to F2. A quickly returning armature is thus more greatly decelerated than a highly damped returning armature which is returning more slowly by virtue of the presence of a number of sheets of paper at the printing station for making a relatively large number of copies. The deceleration of the armature is thus automatically adjusted to compensate for differing numbers of copies.

The remaining elements of the embodiment shown in FIG. 5 are as follows. A spoke 1 of a type wheel is disposed a short distance in front of a piston 2 for printing a character on any number of sheets of paper disposed between the spoke 1 and the platen 2. The embodiment of the plunger-type magnet system constructed in accordance with the principles of the present invention includes an excitation coil 3 and an armature 4 comprised of guide portions 5 and 6. The guide portions 5 and 6 maintain an essentially straight line of travel of the armature 4 through central openings in bushings 7 and 8 and through the central recess ZA in the yoke J about which the coil 3 is wound. The bushings 7 and 8 prevent the armature 4 from being radially drawn to the surface 9 of the yoke J which would impede the axial movement of the armature 4. The rear of the armature 4 abuts a stop 11 in a rest position and is urged to this rest position by a reset spring 10.

The portion of the armature disposed between the two guide portions 5 and 6 consists of a cylindrical principal portion HT and a cylindrical peg ZT which is a projection of the principal portion HT and which has a diameter which is less than that of the principal portion HT. The principal portion HT and the peg ZT are comprised of a material of high magnetic permeability such as, for example, soft iron and each of the principal portion HT and the peg ZT have sharp leading edges UG which cause the magnetic lines of force to converge at those leading edges as those leading edges pass through the interior rim KN of the central opening ZA in the yoke J in a manner similar to that described above in connection with the previous embodiments.

The guide portion 5 of the armature 4, which consists of non-magnetic material, has a recess for receiving the peg ZT in order to form a rigid connection with the principal portion HT. The guide portion 5 simultaneously serves as the print hammer for actuating the spoke 1 of the type wheel and may be comprised of, for example, tempered steel.

In order to facilitate matching of the overall magnet system of FIG. 5 to various use conditions, the peg ZT may be threaded so that the guide portion 5 can be releasably attached to the principal portion HT. Various guide portions 5 of differing lengths and comprised of different materials can then be utilized as needed as the print hammer in order to adapt the magnet system to different conditions.

For purposes of the following discussion, the principal portion HT and the peg ZT will be referred to as the "drive portion" of the armature 4.

Figure 6:
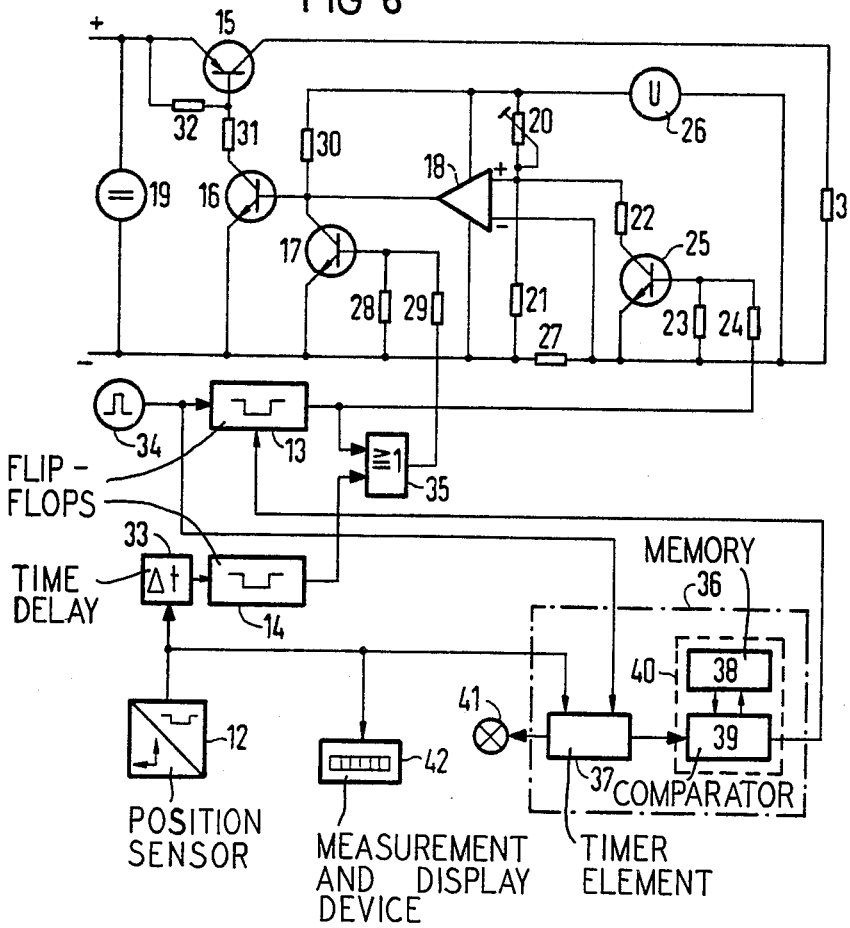
FIG. 6 is a schematic circuit diagram for a control circuit for operating the magnet system of FIG. 5.
Figure 7:
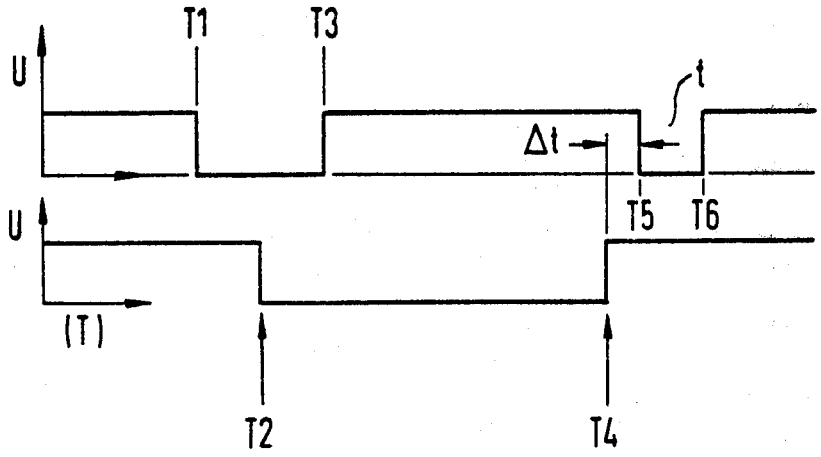
FIG. 7 is a graphic representation of the output pulses of the position sensor shown in FIG. 5 and the associated drive pulses for operating the magnet system in accordance with the principles of the present invention.
Figure 8:
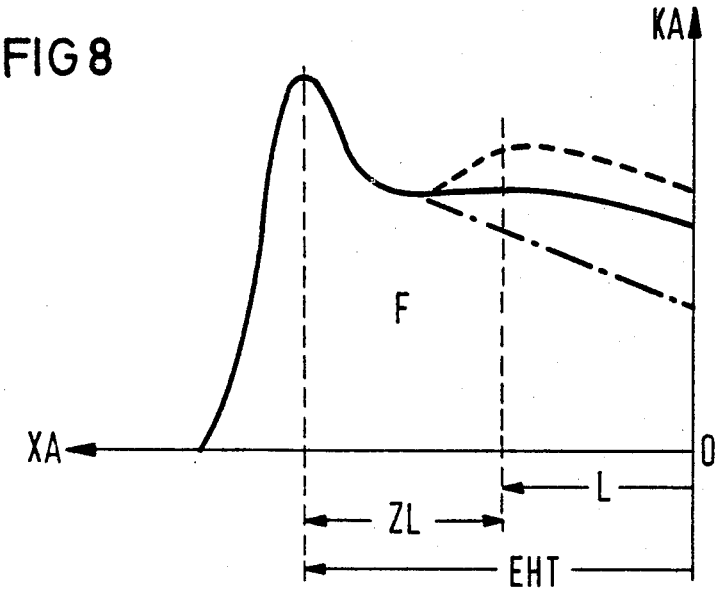
FIG. 8 is a force/displacement diagram for the magnet system shown in FIG. 5.

When the coil 3 is energized by means of the circuit shown in FIG. 6 the armature 4, while closing the effective air gap L, moves essentially on a straight line through the central recess ZA of the yoke J. The curve of the axial fore KA which propels the armature 4 forward as a function of the armature displacement XA is shown in the force/displacement diagram in FIG. 8. The zero coordinate of that diagram indicates abuttment of the armature 4 against the stop 11. When the armature 4 moves toward the left of FIG. 5 under the influence of the magnetic field generated by the excitation coil 3 and supplied over the yoke J, the force first rises due to the closure of the air gap L as the leading edge UG of the peg ZT approaches the rim KN. The force remains approximately constant in the range ZL as the peg ZT is moving through the rim KN and reaches a maximum after the armature has travelled a distance EHT at which time the leading edge UG of the principal portion HT approaches the rim KN. After passage of the drive portion of the armature 4 through the central recess ZA, the force again decreases as shown in FIG. 7. Free flight of the armature 4 up to the act of printing follows this acceleration phase produced by the force KA. The total kinetic energy of the armature 4 corresponds to the area F beneath the curve in FIG. 8.

The curve representing the relationship between the force and displacement of the armature may be varied by changing the ratio of the diameter of the peg ZT to the diameter of the principal portion HT. An enlargement of the diameter of the peg ZT produces an upward distortion in the force/displacement curve in its initial portion (shown by the dashed line in FIG. 8) and a diminution of the diameter of the peg ZT produces a lowering of the curve in the initial area (shown by the dot-dash line in FIG. 8).

A ratio of the diameter of the peg ZT to the diameter of the principal portion HT of approximately 1:2 is preferable. Given such a ratio, and an average axial length of the peg ZT of approximately 4 millimeters, a favorable constant force curve which is suitable for driving the armature over a relatively long distance during the passage of the drive portion of the armature through the central recess of the yoke is obtained. In addition to the above-specified length of the peg ZT, exemplary dimensions for the armature 4 may be a principal portion HT having a diameter of approximately 5 millimeters and a peg ZT having a diameter of 2 to 2.5 millimeters. As stated above, the drive portion of the armature 4 may be comprised of soft iron and the guide portion may be comprised of tempered non-magnetic steel.

The structure of the armature within the inventive concept disclosed herein is not limited to the embodiment shown in FIG. 5 and the peg ZT may itself have a peg thereon in order to provide an additional edge for converging the magnetic lines of force, or peg ZT may exhibit notches or channels similar to those shown in FIGS. 2 and 3 for the same purpose.

A drive circuit for operating the magnet system shown in FIG. 5 is shown in FIG. 6 which is similar to a drive circuit disclosed in the U.S. Pat. No. 4,329,921 (Trieber et al).

The circuit shown in FIG. 6 has two flip-flops 13 and 14 for chronologically controlling the operation of the circuit. Switching transistors 15, 16 and 17 connect the excitation coil 3 to a constant current source 19 and the deceleration current in the coil 3 is controlled as a function of the output signal from an amplifier 18. The amplifier 18 has a non-inverting input which is connected as a current regulator to a voltage divider consisting of resistors 20, 21, 22, 23 and 24 and a switching transistor 25. The resistor 20 is adjustable as a potentiometer. The switching transistor 25, which is driven by the flip-flop 13, changes the division ratio of the voltage divider as a function of the desired current in the coil 3. The voltage divider is connected to a reference voltage source 26 through the resistor 20.

The negative input of the amplifier 18 is connected to a precision resistor 27 for determining the actual value of the current in the coil 3. The additional resistors 28, 29, 30, 31 and 32 are utilized in a known manner for matching the switching transistors. The monostable flip-flop 14 is connected to the output of the position sensor 12 through a time delay element 33 having a delay of $\Delta t$. The circuit is set into operation by a pulse from a pulse source 34 which may be, for example, a keyboard or other suitable input means not illustrated in FIG. 6. The flip-flops 13 and 14 are connected to the control input of the switching transistor 17 through an OR gate 35.

The circuit of FIG. 6 further has an armature control means 36 which includes a timer element 37, connected to the pulse input 34 and to the sensor 12, and a comparative drive means 40 which has a memory 38 and a comparator 39. The output of the comparative drive means 40 is connected to the reset input of the flip-flop 13.

A function warning device 41 such as, for example, a warning light, is connected to the timer element 37, the operation of which is explained further below. A measurement and display device 42 is also connected to the position sensor 12 which is utilized for the basic setting of the printing energy after the magnet system has been built into the printing device, as also described in greater detail below.

The operation of the magnet system shown in FIG. 5 by means of the circuit shown in FIG. 6 is explained with the aid of the voltage/time diagram shown in FIG. 7, wherein voltage U is represented on the vertical axis and time T is shown on the horizontal axis. The upper pulse train shown in FIG. 7 shows the course of the excitation pulses at the output of the OR gate 35, and the lower pulse train shows the course of the excitation pulses at the output of the position sensor 12.

At a point in time T1, the flip-flop 13 is set by means of the pulse received from the pulse source 34 and thus the control path of the switching transistors 17 and 25 is interrupted by the OR gate 35. By so doing the current regulating means including the amplifier 18 and the voltage divider is made operational. The switching transistors 16 and 15, the latter of which is a power transistor, cause the current in the excitation coil to rise sharply to the maximum value determined by the current regulating means.

The armature 4 is accordingly accelerated forward under the influence of the generated magnetic field. At the same time, the timer element 37 of the armature control means 36 which may be, for example, a counter, begins operation. At a point in time T2, the rear termination of the armature 4 passes out of the sensing path (such as a light beam) of the position sensor 12, thereby ceasing interruption of the path, causing a rectangular pulse with a trailing edge to be supplied at the output of the position sensor 12. This rectangular pulse stops the timer element 37 and the resulting measurement is supplied to the comparative control means 40, which can be designed as a microprocessor unit such as INTEL 8080.

The path traversed by the armature 4 from the stop 11 up to the location of the beam path of the position sensor 12 per time unit is a measure for the printing energy exerted. If the traversed time identified by the timer element 37 deviates from a rated time stored in the memory 38, the comparator 39 emits a signal for resetting the flip-flop 13 at a time T3, so that at time T3 the flip-flop 13 returns to its original state and the switching transistors 17 and 25 again become conductive causing the current regulation of the current supplied to the coil 3 to be interrupted and the power transistor 15 to be switched to a non-conducting state. The armature control means 36, through the flip-flop 13, controls the chronological length of the drive of the transistor 15, and thus, the excitation current in the coil 3.

After return of the armature 4 from the printing station, the rear termination of the guide portion 6 again interrupts the path of the position sensor 12 at a point in time T4. The re-interruption of the beam path of the position sensor 12 causes a rising edge in the lower pulse train of FIG. 7 as an output signal of the position sensor 12 which is supplied, delayed by a delay $\Delta t$, to the monostable flip-flop 14 to change the state thereof. The change of state of the flip-flop 14 again interrupts the switching transistor 17 via the OR gate 35 at a point in time T5 and the coil 3 is thus again energized. As a result of the current state of the flip-flop 13, the switching transistor 15 is in a conducting state so that the amplifier 18 regulates the excitation current in the coil 3 to a deceleration current. During the remaining course of travel of the armature 4 up to the stop 11, the armature 4 is completely decelerated by the deceleration current and abuts the stop 11 with virtually no mechanical oscillation. At a time T6, the monostable flip-flop 14 returns to its original state, causing the transistor 17 to again become conducting and the excitation current in the coil 3 is interrupted via the power transistor 15. A further printing cycle can then be initiated by means of another pulse from the source 34.

The warning means 41 connected to the timer element 37 emits a warning signal when the rear termination of the armature 4 has not ceased interrupting the path of the position sensor 12 within a predetermined time span after the actuation of the magnet system. If such a preselected time does in fact elapse without opening the path of the sensor 12, a malfunction in the operation of the magnet system is likely to have occurred such as, for example, a break in the armature 4 or a defect in the excitation coil 3. It is also within the scope of the present invention to employ the time span T4 through T2 of an entire printing cycle, that is, the double interruption of the light barrier, as a measure for enabling the warning means 41 instead of the time span T2 through T1. The function warning means 41 may, for example, be a comparator which compares the counter reading of the timer element 37 to a stored rated reading and activates a warning device if the rated value is exceeded.

The basic setting of the printing energy in the magnet system shown in FIG. 5 can be accomplished in a simple manner after the magnet system is incorporated in a device such as an impact printing device. For this purpose, the resistor 20, operable as a potentiometer, is adjusted to set the magnitude of the excitation current in the coil 3. In addition thereto, a measurement and display device 42 may be connected to the output of the position sensor 12 which may be, for example, a time measuring means and a visual display means. The device 42 measures the time between the initial interruption of the path of the position sensor 12 during a printing stroke up to the re-interruption of the path of the position sensor 12 upon the return of the armature 4 to its initial rest position. The travel time of the armature 4 is a measure of the printing energy and this value for the magnet system after incorporation in the printing device can be compared to a preselected rated time so that the device 42 can be utilized to set the variable resistor 20 to an appropriate value. This permits variations within tolerances which unavoidably occur during fabrication of the various elements and assembly thereof to be balanced so that the fluctuations of the magnetic material and of the coil current produced by such variations are equalized.

The position sensor 12 may be any suitable means for detecting movement of the armature 4 and is not necessarily limited to a photoelectric eye. The position sensor 12 may, for example, measure position by means of induction or may consist of two sensors disposed in the path of the armature 4. Other changes and modifications may be suggested by those skilled in the art, however, it is the intention of the inventor to embody within the patent warranted hereon all changes and modifications as reasonably and properly come within the scope of his contribution to the art.

I claim as my invention:

1. A plunger-type magnet system for actuating a print hammer in a printing device comprising:

a stationary yoke consisting of material of high magnetic permeability and having a central axial recess therein with an interior rim having a sharply-defined annular edge;

an armature which is said print hammer disposed in said central recess of said yoke for axial movement therein and having a drive portion comprised of material of high magnetic permeability;

an excitation coil wound around said armature for generating a magnetic field for axially moving said armature toward said interior rim during a printing stroke; and a circuit means for selectively supplying current to said excitation coil, said armature having a plurality of sharply-defined annular edges on said drive portion formed by an annular channel in said drive portion for cooperating with said interior rim as said drive portion axially moves through said interior rim for causing lines of force of said magnetic field to converge at said edges thereby increasing the kinetic energy of said armature.

2. A plunger-type magnet system for actuating a print hammer in a printing device comprising:

a stationary yoke consisting of material of high magnetic permeability and having a central axial recess therein with an interior rim having a sharply-defined annular edge;

an armature which is said print hammer disposed in said central recess of said yoke for axial movement therein and having a drive portion comprised of material of high magnetic permeability;

an excitation coil wound around said armature for generating a magnetic field for axially moving said armature toward said interior rim during a printing stroke; and a circuit means for selectively supplying current to said excitation coil, said armature having a plurality of sharply-defined annular edges on said drive portion formed by a plurality of saw tooth annular grooves in said drive portion for cooperating with said interior rim as said drive portion axially moves through said interior rim for causing lines of force of said magnetic field to converge at said edges thereby increasing the kinetic energy of said armature.

3. A plunger-type magnet system for actuating a print hammer in a printing device comprising:

a stationary yoke consisting of material of high magnetic permeability and having a central axial recess therein with an interior rim having a sharply-defined annular edge;

an armature which is said print hammer disposed in said central recess of said yoke for axial movement therein and having a drive portion comprised of material of high magnetic permeability;

an excitation coil wound around said armature for generating a magnetic field for axially moving said armature toward said interior rim during a printing stroke; and a circuit means for selectively supplying current to said excitation coil, said drive portion of said armature consisting of a cylindrical principal portion having a leading end which is closest to said interior rim, and at least one peg carried on said leading end of said principal portion, said peg having a diameter which is less than the diameter of said principal portion, said leading edges of said peg and said principal portion closest to said interior rim cooperating with said interior rim as said drive portion axially moves through said interior rim for causing lines of force of said magnetic field to converge at said edges thereby increasing the kinetic energy of said armature, said armature further comprising a non-magnetic guide portion having a recess therein for receiving said peg and which extends through said central recess of said yoke.

4. The magnet system of claim 3 wherein said guide portion is releasably attached to said armature for permitting different drive portions and different guide portions to be interchangeably connected.

5. The magnet system of claim 3 wherein the ratio of the diameter of said peg to the diameter of said principal portion is approximately 1:2.

6. The magnet system of claim 3 wherein said guide portion consists of tempered steel.

7. The magnet system of claim 1 further comprising a pair of bushings each having a central opening therein disposed at opposite ends of said yoke for guiding said armature and preventing radial displacement of said armature.

8. A plunger-type magnet system for actuating a print hammer in a printing device comprising:

a stationary yoke consisting of material of high magnetic permeability and having a central axial recess therein with an interior rim having a sharply-defined annular edge;

an armature which is said print hammer disposed in said central recess of said yoke for axial movement therein and having a drive portion comprised of material of high magnetic permeability;

an excitation coil wound around said armature for generating a magnetic field for axially moving said armature toward said interior rim during a printing stroke; and a circuit means for selectively supplying current to said excitation coil, said armature having a pluralty of sharply-defined annular edges on said drive portion for cooperating with said interior rim as said drive portion axially moves through said interior rim for causing lines of force of said magnetic field to converge at said edges thereby increasing the kinetic energy of said armature;

said armature having a characteristic force/displacement curve having a linearly increasing segment and said circuit means having a means for supplying a deceleration pulse of selected duration to said coil during a return of said armature to a rest position at a point in time at which the position of said armature during said return is in said linearly rising segment of said curve, whereby said armature is decelerated such that mechanical oscillation of said armature upon reaching said rest position is substantially eliminated.

9. A plunger-type magnet system for actuating a print hammer in a printing device comprising:

a stationary yoke consisting of material of high magnetic permeability and having a central axial recess therein with an interior rim having a sharply-defined annular edge;

an armature which is said print hammer disposed in said central recess of said yoke for axial movement therein and having a drive portion comprised of material of high magnetic permeability;

an excitation coil wound around said armature for generating a magnetic field for axially moving said armature toward said interior rim during a printing stroke;

a circuit means for selectively supplying current to said excitation coil, said armature having a plurality of sharply-defined annular edges on said drive portion for cooperating with said interior rim as said drive portion axially moves through said interior rim for causing lines of force of said magnetic field to converge at said edges thereby increasing the kinetic energy of said armature;

a stationary stop against which a rear of said armature abuts in a rest position; and a position sensor disposed at a selected distance from said stop for supplying a signal to said circuit means as said rear of said armature approaches said stop during return of said armature to said rest position after a printing stroke, said signal causing said circuit means to generate a deceleration pulse for energizing said coil for decelerating said armature.

10. The magnet system of claim 9 wherein said circuit means includes a time delay element for delaying generation of said deceleration pulse for a preselected time after said signal is received by said circuit means from said position sensor.

11. The magnet system of claim 10 further comprising a warning means for generating a warning signal if a signal is not received from said position sensor after a specified time has elapsed after said coil is energized for a printing stroke.

12. The magnet system of claim 9 wherein said circuit means includes an armature control means for controlling the current supplied to said excitation coil as a function of the speed of said axial movement of said armature as measured by said position sensor.

13. The magnet system of claim 12 wherein said printer includes a means for initiating a printing stroke of said armature and wherein said armature control means comprises:

a timer element connected to said means for initiating a printing stroke and to said position sensor for measuring the elapsed time between initiation of said printing stroke and the receipt of a signal from said position sensor;

a memory having a selected rated elapsed time stored therein; and a comparator connected to said memory and said timer element for comparing the elapsed time measured by said timer element with said rated elapsed time and for supplying a control signal for initiating generation of said deceleration pulse by said circuit means in dependence upon said comparison.

14. The magnet system of claim 12 wherein said circuit means includes a means for setting the current supplied to said excitation coil for adjusting the kinetic energy of said armature to compensate for changes in the time required by said armature to substantially complete a printing stroke and a return stroke.

15. The magnet system of claim 14 wherein said means for controlling the current supplied to said excitation coil is a potentiometer.

* * * * *